United States Patent [19]

Worship et al.

[11] Patent Number: 4,945,748

[45] Date of Patent: Aug. 7, 1990

[54] APPARATUS FOR THE MANUFACTURE OF FOUR-SIDED SHEET METAL CONTAINERS

[75] Inventors: Leslie A. Worship, Stellenbosch; Peter Isaacs, Mitchells Plain, both of South Africa; Steven Bain, Kitchener, Canada; Kenneth J. D. Bain, Cape Town, South Africa

[73] Assignee: Marsden (Proprietary) Limited, Philippi, South Africa

[21] Appl. No.: 303,301

[22] Filed: Jan. 30, 1989

[30] Foreign Application Priority Data

Jan. 28, 1988 [ZA] South Africa ..... 88/0598

[51] Int. Cl.[5] ..... B21D 5/16; B21D 51/16

[52] U.S. Cl. ..... 72/323; 493/176; 72/319

[58] Field of Search ..... 72/323, 319, 320, 306, 72/316, 388, 384; 493/176, 175, 167

[56] References Cited

U.S. PATENT DOCUMENTS

| | | | |
|---|---|---|---|
| 145,660 | 12/1873 | Kuessner | 72/323 |
| 160,747 | 3/1875 | Bowers | 72/323 |
| 195,035 | 9/1877 | Morgan | 72/323 |
| 412,242 | 10/1889 | Dawson | 72/323 |
| 430,835 | 6/1890 | Codding et al. | 72/323 |
| 548,680 | 10/1895 | Votaw | 493/167 |
| 926,866 | 7/1909 | Halbreich | 493/167 |
| 939,888 | 11/1909 | Bertin | 493/167 |

*Primary Examiner*—Daniel C. Crane

*Attorney, Agent, or Firm*—Fleit, Jacobson, Cohn, Price, Holman & Stern

[57] ABSTRACT

Apparatus for making tapered four-sided sheet metal containers comprises a tapered four-sided mould 42 and a folding mechanism 26.1 for folding a sheet metal blank onto the mould. The folding mechanism comprises a carrier 28 and four folding elements 30, 32 pivotally mounted on the carrier. When the mould and the folding mechanism is displaced towards one another with the sheet metal blank 10 disposed between them, the folding elements pivot about their pivotal mountings and fold peripheral portions of the blank onto the sides of the mould.

2 Claims, 4 Drawing Sheets

APPARATUS FOR THE MANUFACTURE OF FOUR-SIDED SHEET METAL CONTAINERS

BACKGROUND OF THE INVENTION

THIS INVENTION relates to apparatus for making tapered four-sided sheet metal containers, such as, for example, baking tins, bread pans, or the like, and to a method of making such containers. The invention also relates to such a container.

SUMMARY OF THE INVENTION

According to the invention there is provided apparatus for making tapered four-sided sheet metal containers, which apparatus comprises a tapered four-sided mould, and folding means for folding a sheet metal blank onto the mould, the folding means comprising a carrier and four folding elements mounted pivotally on the carrier, and the folding elements being arranged each to engage a peripheral portion of the blank and, by pivotal displacement of the folding element with respect to the carrier, to fold said peripheral portion onto the corresponding side of the mould.

The mould may have four corner edges which together define a first rectangle, each of the four sides of the mould extending from a corresponding one of said corner edges; the pivot axis of each folding element being parallel to the corresponding corner edge of the mould so that the pivot axes together define a second rectangle, the width of the second rectangle being greater than the width of the first rectangle and the length of the second rectangle being greater than the length of the first rectangle; and the mould and the folding means being displaceable towards one another, folding of said peripheral portions of the blank taking place simultaneously as the mould and the folding means are displaced towards one another with the blank being disposed between them.

The mould, in the region thereof corresponding to the rim of the container, may have a channel-like formation facing the folding means, the arrangement of each folding element being such that an outer edge of the folding element enters into the channel-like formation as the mould and the folding means are being displaced towards one another, thereby to form the corresponding peripheral portion of the blank with a return-folded edge strip at the rim of the container.

Further according to the invention there is provided a method of making a tapered four-sided sheet metal container, which method comprises simultaneously folding four peripheral portions of a sheet metal blank to form the four sides of the container, about fold lines which define a rectangular bottom panel of the container, the corners where adjacent fold lines meet being spaced inwardly of the periphery of the blank so that a pleat is formed in the blank between each pair of adjacent peripheral portions, which pleat extends outwardly from the respective corner and is subsequently folded flat against an adjacent side of the container.

Each adjacent pair of the peripheral portions may be separated by a V-shaped cut-out in the blank, the pleats each being formed to extend from a corresponding one of said corners to the apex of the corresponding cut-out.

During folding of the peripheral portions about said fold lines, each peripheral portion may further be folded to form it with a return-folded edge strip at the rim of the container; an edge frame being subsequently inserted behind the return folded edge strips, and the return folded edge strips then being clinched to secure the edge frame in position.

The invention extends to a tapered four-sided sheet metal container which comprises a rectangular bottom panel and four side wall panels each joined to the bottom panel by a fold in the sheet metal, there being a pleat in the sheet metal between adjacent wall panels which pleat extends from the corresponding corner of the bottom panel, said pleats extending only part of the height of the wall panels.

The pleat may extends less than one third the height of the wall panels.

The container may include an edge frame secured to the container by being clinched behind return-folded edge strips along the rim of the container, the edge frame comprising a strip of sheet metal which is folded double longitudinally of the strip.

The invention further extends to a tapered sheet metal container which comprises a bottom panel, side wall panels, and an edge frame which is secured to the container by being clinched behind return folded edge strips along the rim of the container, the edge frame comprising a strip of sheet metal which is folded double longitudinally of the strip.

The invention will now be described in more detail, by way of example, with reference to the accompanying drawings.

DETAILED DESCRIPTION OF PREFERRED EMBODIMENT

Figure 1:
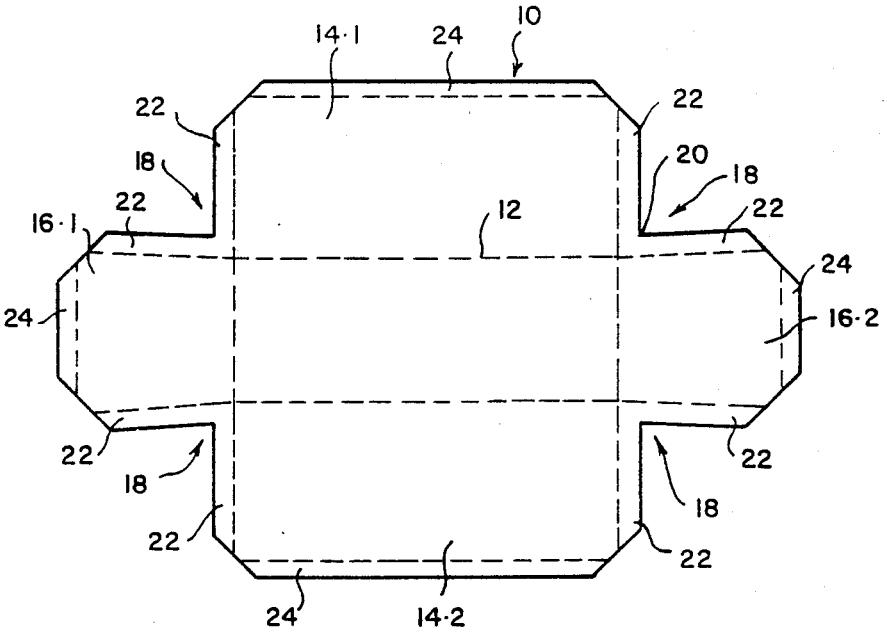
FIG. 1 is a plan view of a sheet metal blank for a bread pan in accordance with the invention.

Referring first to FIG. 1, reference numeral 10 designates a sheet metal blank for a bread pan. After folding of the blank as will be described hereinafter, a rectangular central portion 12 thereof becomes the bottom panel of the bread pan, peripheral portions 14.1 and 14.2 become major sides of the pan, and peripheral portions 16.1 and 16.2 become minor sides of the pan. Adjacent peripheral portions are separated by V-shaped cut-outs 18, the apex 20 of each cut-out being spaced from the corresponding corner of the bottom panel 12. Each of the peripheral portions 14.1, 14.2, 16.1, and 16.2 has a corner strip 22 along each opposite side edge thereof. Furthermore, each of the peripheral portions has an edge strip 24 along the free edge thereof.

Figure 2:
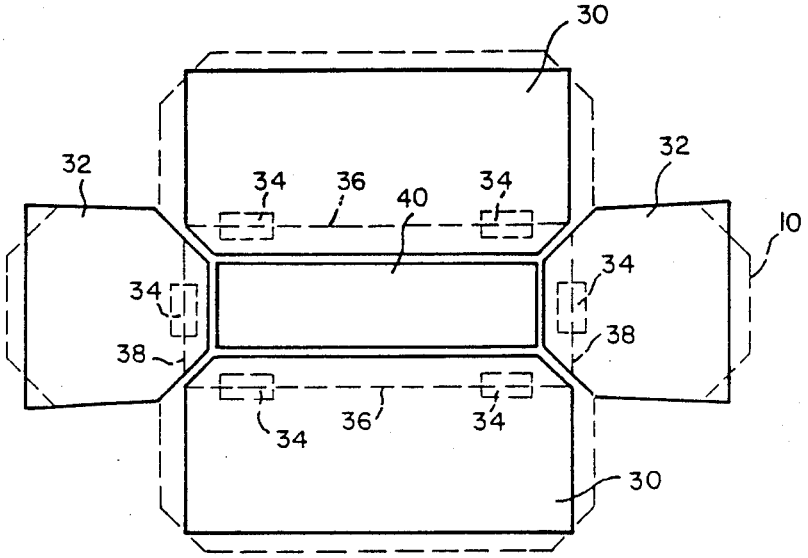
FIG. 2 is an underneath view of the upper working parts of apparatus for making the bread pan.
Figure 3:
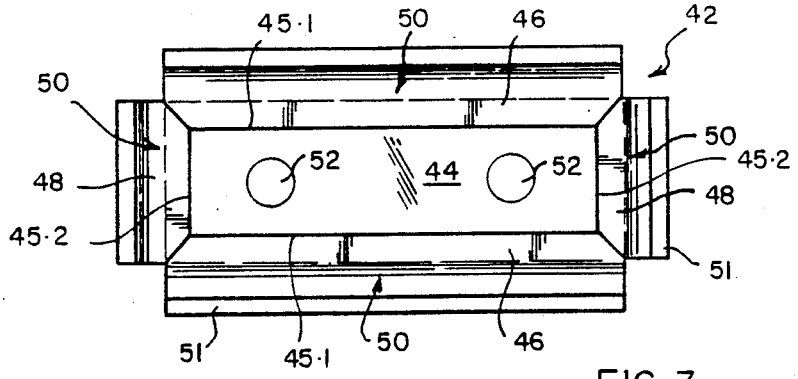
FIG. 3 is a plan view of the lower working parts of the apparatus.
Figure 4:
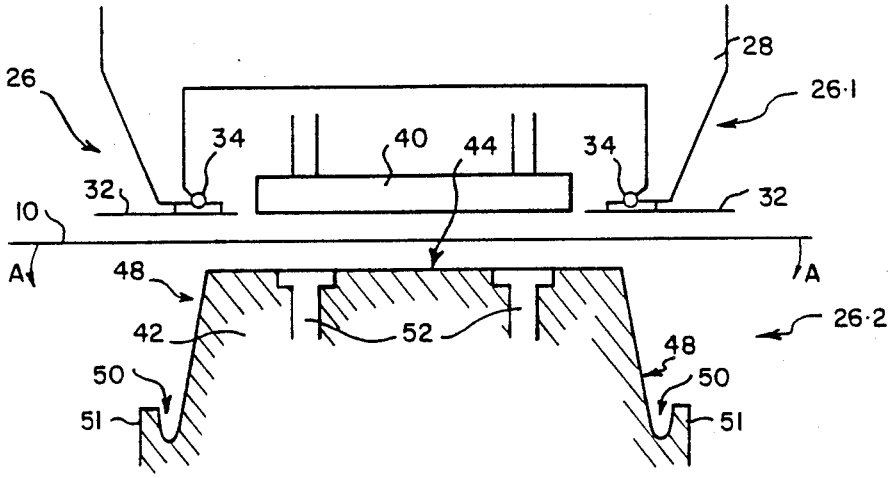
FIG. 4 is a diagrammatic, vertical section through the upper and lower working parts of the apparatus during an initial stage of the procedure to make a bread pan from the sheet metal blank of FIG. 1.

Referring now to FIGS. 2 to 4, reference numeral 26 in FIG. 4 generally indicates apparatus for forming a bread pan from the blank of FIG. 1. The apparatus comprises upper working parts 26.1 and lower working parts 26.2 which are mounted in a hydraulic press for forcibly bringing the upper and lower working parts together.

The upper working parts 26.1 include a carrier 28 and four folding elements, namely a pair of major folding elements 30 and a pair of minor folding elements 32. The folding elements 30, 32 are pivotally mounted on the carrier 28 by means of hinges 34, each of the folding elements 30 being pivotal with respect to the carrier about a corresponding pivot axis 36, and each of the folding elements 32 being pivotal with respect to the flap carrier about a corresponding pivot axis 38. Biasing means (not shown) are provided to bias the folding elements 30, 32 to their horizontally extending positions as illustrated in FIG. 4.

The upper working parts 26.1 further include a pneumatic trapper 40 which is displaceable vertically with respect to the carrier 28 by means of pneumatic cylinders (not shown).

The lower working parts 26.2 comprise a mould 42 which generally corresponds to the inside shape of an inverted bread pan. The mould has a rectangular upper face 44 which corresponds to the shape of the bottom panel 12. The upper face is defined by corner edges 45.1 and 45.2. The mould further has a pair of downwardly diverging faces 46 corresponding to the major sides of the bread pan, and a pair of downwardly diverging minor faces 48 corresponding to the minor sides of the bread pan. The spacing between the pivot axes 36 is greater than the spacing between the corner edges 45.1. Likewise, the spacing between the pivot axes 34 is greater than the spacing between the corner edges 45.2. At the bottom of each of the faces 46, 48 there is an upwardly facing channel-like formation 50 formed inwardly of outer ridges 51. Associated with the mould 42 there are a pair of ejectors 52 which, in FIG. 4, are shown in their retracted positions. The ejectors 52 are upwardly displaceable to eject a folded blank from the mould 42.

Figure 5:
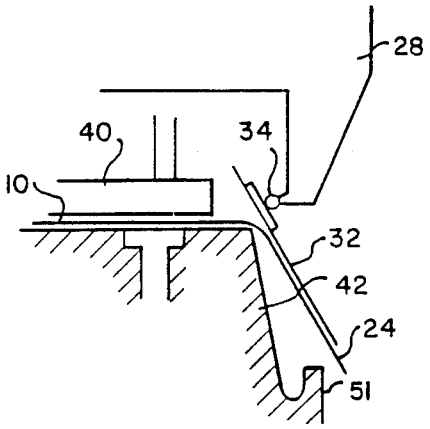
FIGS. 5 to 7 show the right hand side of the working parts of FIG. 4 during subsequent stages as the upper and lower working parts are progressively brought together.
Figure 6:
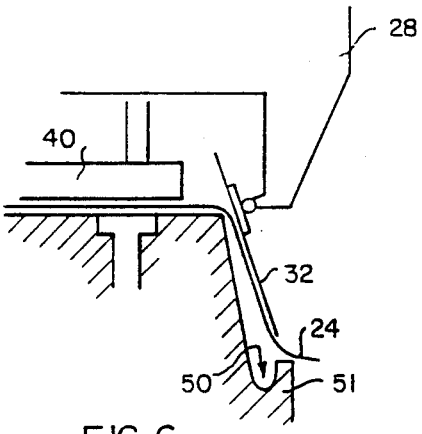

The operation of the apparatus will now be described with reference to FIGS. 4 to 7. First, the blank 10 is fed in a horizontal direction into the space between the upper and lower working parts 26.1, 26.2 and located horizontally by means of positioning devices (not shown). The trapper 40 is now lowered and holds the blank 10 against the upper face 44 of the mould 42, as illustrated in FIGS. 5 to 7.

Thereafter, the carrier 28 is lowered onto the blank 10, the position of the blank with respect to the folding elements 30, 32 being shown in dotted outline in FIG. 2. The width and length respectively of the rectangle defined by the pivot axes 36 and 38 are slightly greater than the width and length of the rectangular face 44. As the carrier 28 is lowered further, the mould 42 thus presses via the blank 10 against those portions of the folding elements 30, 32 which are on the inside of the pivot axes 36 and 38, causing the folding elements to pivot in the direction of arrows A, against their bias. As shown in FIG. 5, this pivotal displacement of the folding elements 30, 32 bends all the peripheral portions 14.1, 14.2, 16.1, and 16.2 simultaneously around the corners at the periphery of the face 44. As the free edges of the folding elements 30, 32 move inwardly of the ridges 51, the edge strips 24 are bent, as illustrated in FIG. 6.

Figure 7:
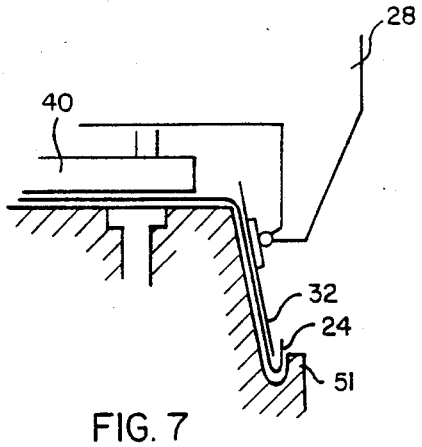
Figure 8:
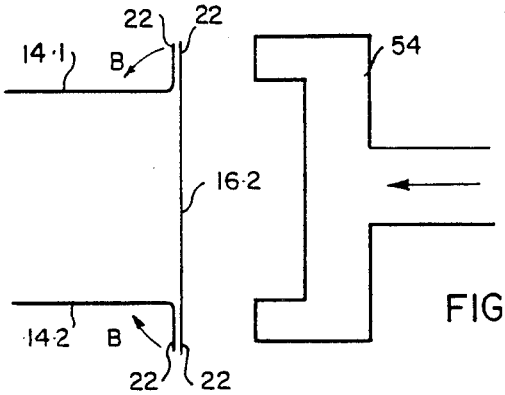
FIG. 8 illustrates the operation of a ram (as seen from above) to fold overlying corner strips of the blank.

Further lowering of the carrier 28 causes the free edges of the folding elements 30, 32 to enter into the channel-like formations 50 to form a return bend where the edge strips 24 join the rest of the corresponding peripheral portions 14.1, 14.2, 16.1, and 16.2 and brings the peripheral portions hard up against the corresponding faces 46, 48 of the mould 42, as illustrated in FIG. 7. Furthermore, the folding elements 30 and 32 will bend the corner strips 22 of the major portions 14.1, 14.2 through 90°, so that the blank will now be as shown in FIG. 8 with the corner strips 22 of the minor portions 16.1, 16.2 overlying the corner strips 22 of the major portions 14.1, 14.2. Where the corner strips 22 meet, adjacent the apices 20, a pleat 53 (see FIG. 9) is formed in the blank. Each pleat 53 extends from the corresponding corner of the bottom panel 12 to the corresponding apex 20. Because the spacing of the pivot axes 34 and 36 is wider than that of the corner edges 45.1 and 45.2, the carrier 28 is able to move down sufficiently far for the pivot axes 34 and 36 to move downwardly beyond the level of the corner edges 45.1 and 45.2.

The carrier 28 is now retracted so that it returns to the position illustrated in FIG. 4. The folded blank 10 remains behind on the mould 42.

A pair of rams 54 (only one of which is shown in FIG. 8) are now displaced inwardly from opposite ends of the folded blank and fold the overlying corner strips 22 over in the direction of arrows B in FIG. 8 until the corner strips, and also the pleats 53, lie flat against the major portions 14.1, 14.2.

Finally, an edge frame 56 is dropped into the channel formed by the return-folded edge strips 24, and the edge strips clinched (as shown at 58 in FIG. 9) to retain the edge frame in position.

The trapper 40 is now retracted and the ejectors 52 operated to eject the folded blank from the mould 42, whereupon the folded blank is removed from between the parts 26.1 and 26.2. It will be appreciated that the separation between the carrier 28 and the face 44 of the mould 42 should be sufficient to enable the folded blank to be removed from between these two parts.

Figure 9:
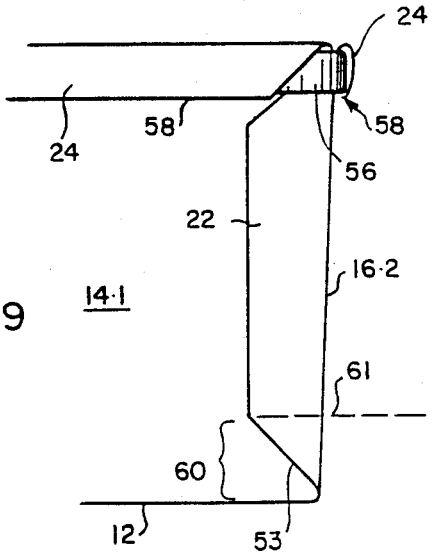
FIG. 9 is a side view of one end of the bread pan when in its finished condition.

By virtue of the spacing between the apices 20 and the corners of the bottom panel 12, the pleat has a height 60 (see FIG. 9). This will ensure that the bread pan is water-tight up to the level 61, which is sufficient for the purposes of a bread pan. In the example illustrated the height of the pan is about 11 cm and the distance 60 about 2 cm. If the height 60 is too small the level to which the pan is water-tight is too small. On the other hand, if the height 60 is too great, the weight of the pan will be unnecessarily high as a result of the unnecessarily wide corner strips 22.

Figure 10:
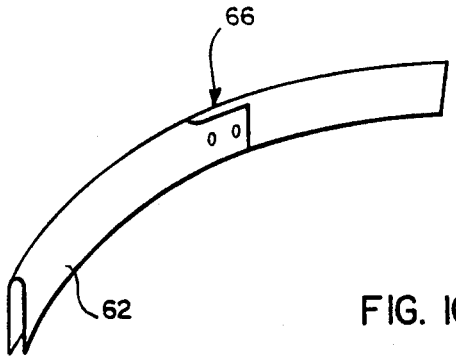
FIG. 10 is a three dimensional view of part of an edge frame for the pan, during an initial stage in its production.
Figure 11:
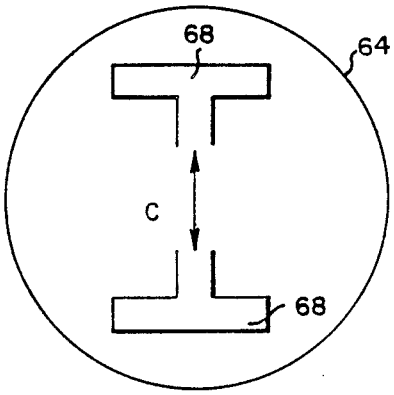
FIG. 11 illustrates diagrammatically the formation of the edge frame from a circular into a suitable rectangular shape.

The edge frame 56 can be made of any suitable material. However, it has been found advantageous to construct the frame 56 from sheet metal, as will be described with reference to FIGS. 10 and 11. First, a strip of sheet metal 62 is folded double longitudinally as illustrated in FIG. 10. The length of doubled up sheet metal is then formed by rollers into a ring 64 and the ends joined by a halved lap joint as indicated at 66 in FIG. 10. Spot welding or some other suitable form of connection may be used for this purpose. The ring 64 is then placed in a tensioning device having opposed flat heads 68. The ring is flattened against each of the heads 68 by means of pneumatic cylinders (not shown) and the heads then moved apart in the direction of arrows C by means of a hydraulic cylinder (not shown). This forms the ring 64 into a rectangular frame for use with the bread pan. If a suitable ductile sheet metal is used, it is possible to stretch the ring somewhat to form frames of different sizes from the same length of strip 62. As the joint 66 is normally the weakest point of the ring 64, the ring is arranged in the tensioning device so that part of the ring which is in the region of the joint is clamped to one of the heads 68. This will minimise the tension in the ring at the joint when the ring is stretched.

The edge frame 56 could be fitted while the folded blank is still in position on the mould 42. However, it may be advantageous to fit the edge frame to the folded blank in a separate operation remote from the apparatus 26, i.e. after the folded blank has been ejected from the apparatus.

We claim:

1. Apparatus for making tapered four-sided sheet metal containers, which apparatus comprises a tapered four-sided mould, and folding means for folding a sheet metal blank onto the mould, the folding means comprising a carrier and four folding elements mounted pivotally on the carrier, and the folding elements being arranged each to engage a peripheral portion of the blank and, by pivotal displacement of the folding element with respect to the carrier, to fold said peripheral portion onto the corresponding side of the mould;

wherein the mould has four corner edges which together define a first rectangle, each of the four sides of the mould extending from a corresponding one of said corner edges;

wherein the pivot axis of each folding element is parallel to the corresponding corner edge of the mould so that the pivot axes together define a second rectangle, the width of the second rectangle being greater than the width of the first rectangle and the length of the second rectangle being greater than the length of the first rectangle;

wherein the mould and the folding means are displaceable towards one another, folding of said peripheral portions of the blank taking place simultaneously as the mould and the folding means are displaced towards one another with the blank being disposed between them, said mould and folding elements being positioned so that folding of the blank is produced by displacement of the folding elements and the mould relative to one another with the pivot axes passing the level of the first rectangle; and wherein the mould, in the region thereof corresponding to the rim of the container, has a channel-like formation facing the folding means, the arrangement of each folding element being such that an outer edge of the folding element enters into the channel-like formation as the mould and the folding means are being displaced towards one another, thereby to form the corresponding peripheral portion of the blank with a return-folded edge strip at the rim of the container.

2. Apparatus for making tapered four-sided sheet metal containers, which apparatus comprises a tapered four-sided mould, and folding means for folding a sheet metal blank onto the mould, the folding means comprising a carrier and four folding elements mounted pivotally on the carrier, and the folding elements being arranged each to engage a peripheral portion of the blank and, by pivotal displacement of the folding element with respect to the carrier, to fold said peripheral portion onto the corresponding side of the mould;

wherein the mould has four corner edges which together define a first rectangle, each of the four sides of the mould extending from a corresponding one of said corner edges;

wherein the pivot axis of each folding element is parallel to the corresponding corner edge of the mould so that the pivot axes together define a second rectangle, the width of the second rectangle being greater than the width of the first rectangle and the length of the second rectangle being greater than the length of the first rectangle;

wherein each folding element has an outer portion extending outwardly from the corresponding pivot axis and an inner portion connected rigidly to the outer portion and extending inwardly from the corresponding pivot axis; and wherein the mould and the folding means are displaceable towards one another, folding of said peripheral portions of the blank taking place simultaneously as the mould and the folding means are displaced towards one another with the blank being disposed between them, said mould and folding elements being positioned so that folding of the blank is produced by displacement of the folding elements and the mould relative to one another with the pivot axes passing the level of the first rectangle.

* * * * *